US012508647B2

(12) United States Patent
Graf et al.

(10) Patent No.: US 12,508,647 B2
(45) Date of Patent: Dec. 30, 2025

(54) CASTING APPARATUS AND CASTING METHOD FOR PRODUCTION OF METAL MATRIX COMPOSITE MATERIALS

(71) Applicant: CMMC GmbH, Chemnitz (DE)

(72) Inventors: Marcel Graf, Chemnitz (DE); Robert Pippig, Chemnitz (DE); Thomas Lampke, Chemnitz (DE)

(73) Assignee: CMMC GmbH, Chemnitz (DE)

( * ) Notice: Subject to any disclaimer, the term of this patent is extended or adjusted under 35 U.S.C. 154(b) by 169 days.

(21) Appl. No.: 18/683,131

(22) PCT Filed: Aug. 1, 2022

(86) PCT No.: PCT/IB2022/057111
§ 371 (c)(1),
(2) Date: Feb. 12, 2024

(87) PCT Pub. No.: WO2023/017358
PCT Pub. Date: Feb. 16, 2023

(65) Prior Publication Data

US 2025/0135526 A1 May 1, 2025

(30) Foreign Application Priority Data

Aug. 12, 2021 (DE) ..... 10 2021 121 004.6

(51) Int. Cl.
*B22D 11/108* (2006.01)
*B22D 11/103* (2006.01)

(52) U.S. Cl.
CPC ..... *B22D 11/108* (2013.01); *B22D 11/103* (2013.01)

(58) Field of Classification Search
CPC .... B22D 11/103; B22D 11/108; B22D 19/14; B22D 35/00; B22D 23/00
See application file for complete search history.

(56) References Cited

U.S. PATENT DOCUMENTS 4,786,467 A 11/1988 Skibo et al.
4,961,461 A * 10/1990 Klier ..... B22D 11/00 164/97

(Continued)

FOREIGN PATENT DOCUMENTS

DE 69223950 T2 6/1998
EP 3586999 A1 1/2020

*Primary Examiner* — Keith Walker
*Assistant Examiner* — Steven S Ha
(74) *Attorney, Agent, or Firm* — Laurence A. Greenberg; Werner H. Stemer; Ralph E. Locher

(57) ABSTRACT

A casting apparatus for producing metal matrix composite materials includes a melt channel inclined in an apparatus flow direction, a flow pathway for a metal melt, and a particle feed device for adding solid particles to the metal melt. A casting method includes adding solid particles to a metal melt flowing in a continuous flow down a melt channel. The particle feed device is a shaft extending at least up to a base of the flow pathway and having a particle exit window in a casing of the shaft. The metal melt flowing down along the flow pathway is divided into two partial streams flowing around the channel projecting into and dividing the flow pathway. Where the partial streams combine again after flowing around the channel, the solid particles trickle into the confluence of the partial streams via a particle exit window in the channel located above the flow pathway.

10 Claims, 2 Drawing Sheets

(56) References Cited

U.S. PATENT DOCUMENTS

| | | | |
|---|---|---|---|
| 5,531,425 | A | 7/1996 | Skibo et al. |
| 6,253,831 | B1 | 7/2001 | Genma et al. |
| 6,547,850 | B1 | 4/2003 | Skibo et al. |
| 7,509,993 | B1 | 3/2009 | Turng et al. |
| 2020/0001355 | A1 | 1/2020 | Just |

* cited by examiner

CASTING APPARATUS AND CASTING METHOD FOR PRODUCTION OF METAL MATRIX COMPOSITE MATERIALS

FIELD AND BACKGROUND OF THE INVENTION

The present invention relates to a casting apparatus for producing metal matrix composite materials having a melt channel which is inclined in a flow direction of the casting apparatus with a flow pathway for a metal melt, and a particle feed device for adding solid particles to the metal melt. The invention further relates to a casting method for producing metal matrix composite materials in which solid particles are added to a metal melt while the metal melt is flowing in a continuous flow down a melt channel.

Metal matrix composite (MMC) materials are metals or metal alloys containing solid particles. Such particle-reinforced metals or metal alloys offer significantly higher wear resistance and/or increased strength, in particular increased heat resistance, compared to their non-reinforced variants.

The solid particles used in MMC materials can be ceramic particles, for example. The solid particles may consist of metal oxide(s), preferably aluminum oxide, metal nitride(s), metal carbide(s), preferably silicon carbide, metal silicide (s), and/or glass. Metal matrix composite materials, particularly aluminum matrix composite (AMC) materials, were first considered commercially in the early 1970s. The motivation came primarily from the need for more efficient lightweight construction materials for aerospace and for military applications. At the end of the 1980s, research led to first practical production methods.

Nevertheless, only a few commercial applications of MMC have hitherto been developed, as the too low robustness of the established MMC production methods, despite complex process management, leads to fluctuating material qualities and additional post-processing costs for the MMC products and thus so far to high MMC material costs. Despite their great application potential, MMC materials are therefore only found in niche applications or high-end technologies. At present, it is not foreseeable that any of the global suppliers of MMC materials will overcome the hurdle of the cost-benefit ratio required for large-scale production.

There are currently only a few solutions for introducing particles into a completely liquid metal melt. The existing problems arise from the oxide layer forming on the metal melt, which prevents the particles from sinking in, the mixing of surface oxides into the metal melt and the uneven distribution and wetting of the particles in the metal melt.

The idea of adding the particles in a vacuum to an already prepared melt and distributing them therein by means of stirrers comes from U.S. Pat. No. 4,786,467 B1. The stirrer having a plurality of stirring arms arranged one above the other ensures that the shear forces are sufficiently high for wetting.

In the stirring technology described in U.S. Pat. No. 6,547,850 B1, the particles are introduced into a crucible via a hollow stirrer under the melt surface and are set in rotation simultaneously by the stirrer. This overcomes the challenge of the particles having to break through the oxide layer, which also forms in a vacuum. The rotation also results in a homogeneous distribution and wetting of the particles in the metal melt.

U.S. Pat. No. 6,253,831 B1 also describes the addition of particles to a melt in a crucible, with only part of the overall system, i.e. the crucible and the mixing unit, being operated in a vacuum. The mixing of melt and particles is realized by a combination of ultrasonic treatment and electromagnetic stirring by means of induction coils.

In U.S. Pat. No. 7,509,993 B1, a matrix alloy is first melted in a crucible, followed by the addition of nanoparticles. In order for the nanoparticles to be embedded in the matrix, a melt treatment is carried out by means of vibration or ultrasound. This not only achieves homogeneous distribution and wetting, but also supports cooling and thus converts the compound melt into a partially solidified, i.e. mushy to doughy, state. The partially solidified MMC melt will subsequently be used for thixoforming in order to directly produce components with improved mechanical properties through a combination of primary and secondary forming.

The known technologies listed above are all batch solutions which are based on discontinuous process management and have weaknesses in their reproducibility or can only be modified with difficulty for continuous process management.

As the respective batch technologies are usually carried out under vacuum, a sealed container is correspondingly required. When refilling material, the vacuum must be released, raw material must be added, then the melt container must be evacuated again and the vacuum must be set again.

DE 692 23 950 T2 describes a stir casting process for the continuous production of metal matrix composite material, in which a plurality of mixing stages are used, wherein in each of the mixing stages the metal melt is mixed with the particulate material introduced therein, for example with a dispersion stirring blade to achieve sufficient shearing of the metal melt against the particulate material until sufficient wetting of the particles with the metal has taken place. However, this process is very complicated.

Another continuous process for producing composite material melts is shown in EP 3 586 999 A1. The focus here is on inline ultrasonic treatment for homogeneous distribution and wetting of the solid addition in a metal melt. This ultrasonic treatment again has the function of lowering the melt temperature so that the semi-liquid composite material can be further processed in die casting machines.

The disadvantage of this technology is that the ultrasonic effect on the melt loaded with the particles only occurs when the melt flows past the respective sonotrodes. Due to the limited exposure time and the locally limited effective range, the desired homogeneous mixing can only be achieved throughout the material with this technology if the ultrasonic treatment is carried out at a high frequency and/or is very time-intensive.

If such a process takes place in a normal atmosphere, oxidation of the melt surface is also to be expected, as a result of which the introduction of solids is made more difficult and the oxidation products of the metal melt can be mixed into the melt during ultrasonic treatment.

The disadvantages of the batch solutions associated with the vacuum used are eliminated in continuous processes. Instead, raw material can be refilled at any time in continuous processes. However, this takes place at the expense of impurities in the near-surface melt region.

Furthermore, in the prior art, the approach exists to split the corresponding melt stream into a plurality of partial melt streams by means of a channel system constructed in a cascade-like manner with the aim of greatly increasing the surface area of the partial melt streams compared to the original total melt stream and to allow them to trickle into these solid particles. However, this can result in very thin melt films that can tear off, or runlets can form so that the solid particles can hit areas in which there is no melt at all. Furthermore, due to the increase in the melt surface area, the oxide content increases significantly in relation to the melt volume, which has a negative effect on both the process management of the liquid melt and the properties of the solidified material. Even under vacuum conditions, the proportion of oxide inclusions in the MMC melt is very high with this technology. The cascade principle also provides high demands on the surface quality of the channels and also on their geometric design, which depends on both the melt and the process temperatures.

In addition, there is a technology for producing composite metal powder in the prior art. Here, particles are added onto or into a very thin melt stream, which is subsequently atomized to produce the pulverulent composite material.

SUMMARY OF THE INVENTION

It is therefore the object of the present invention to provide a casting apparatus and a casting method which, with low technological effort, enable continuous production of metal matrix composite materials with high homogeneity and wetting of the respective solid particles introduced into the metal matrix.

This object is achieved on the one hand by a casting apparatus for producing metal matrix composite materials having a melt channel which is inclined in a flow direction of the casting apparatus with a flow pathway for a metal melt, and a particle feed device for adding solid particles to the metal melt, with the particle feed device being designed as a particle feed shaft extending at least up to a base of the flow pathway and having a particle exit window formed in a shaft casing of the particle feed shaft.

In the present invention, the particle feed shaft performs two functions.

On the one hand, the particle feed shaft projecting into the flow pathway divides the melt flowing in the melt channel into two partial streams. These partial streams flow around the particle feed shaft on both sides and combine again after flowing around the particle feed shaft. The two partial streams continue to flow in the melt channel, the cross-section of which is preferably constant. Accordingly, there is no significant increase in the surface area of the partial streams compared to the previous total melt stream and thus no increased oxide formation on the melt surface, which, as explained above, would not only make it more difficult to introduce particles into the melt, but would also have a negative effect on the properties of the subsequently solidified material.

On the other hand, the solid particles are trickled into the metal melt through the particle exit window of the particle feed shaft in a region of the melt channel where the two partial streams flow together again.

The flow conditions resulting from when the partial streams flow together virtually draw the solid particles into the metal melt, resulting in particularly good injection of the solid particles below the melt surface.

Raw material and solid particles can be continuously added to the casting apparatus according to the invention. Furthermore, a metal matrix composite material can be continuously produced using the casting apparatus according to the invention.

The casting apparatus according to the invention is also very robust with respect to process fluctuations and varying requirements. All its components are easy to maintain and service.

The present invention further allows the metal melt to be heated upstream of and/or in the melt channel, which facilitates continuous process management due to the metal melt which can always be maintained in the liquid state, and/or the solid particles can be heated upstream of and/or in the particle feed channel, which can prevent the solid particles introduced into the metal melt from partially cooling the metal melt and leading to premature solidification and the formation of lumps in the metal melt.

In a preferred embodiment of the casting apparatus according to the invention, the melt channel is designed as a melt channel tube, the particle feed shaft is guided through a casing feedthrough formed opposite the flow pathway in a tube casing of the melt channel tube to the flow pathway, and the particle exit window is arranged inside the melt channel tube.

This structural design of the casting apparatus according to the invention is easy to implement and creates the best conditions for continuous particle introduction into the metal melt flowing continuously in the melt channel. Due to the closed design of the melt channel as a melt channel tube and the direct branching off of the particle feed shaft into the melt channel tube, there is no open melt surface during particle introduction, which means that the above-mentioned disadvantages of the prior art can be avoided.

In principle, in the present invention, a melt channel profile that is not circumferentially closed can also be used for the melt channel instead of the melt channel tube.

The particle feed shaft inserted laterally into the melt channel tube is preferably welded to the melt channel tube. This creates a closed particle feed system that enables loss-free, targeted and clean particle feed to the metal melt.

The angle between the melt channel tube and the particle feed shaft can be used to influence the speed and thus the quantity per time at which the solid particles are introduced into the metal melt.

Preferably, the particle feed shaft is designed as a particle feed tube. The particle feed tube can have both a round and an angular cross-section. Due to its closed circumference, the tubular shape of the particle feed shaft enables easy filling and loss-free feeding of the solid particles to and into the melt channel, largely independent of ambient conditions.

It is particularly preferable for the particle feed tube to have a smaller tube cross-section than the melt channel tube.

When the word tube is used in the description of the present invention, for example for the term melt channel tube, this is not limited to round tube cross-sections, but can also have an angular tube cross-section, such as a rectangular tube cross-section. Furthermore, the corresponding tube can have at least one kink and/or at least one bend.

The solid particles can be easily guided inside the particle feed shaft in the direction of the particle exit opening if a transverse base opening into the particle exit opening is formed in the particle feed shaft.

The transverse base is preferably inclined in a particle exit direction. On the one hand, this can be realized by arranging the transverse base at an angle in the particle feed shaft, whereby the transverse base has an elliptical shape with a round internal cross-section of the particle feed shaft. If the installation angle of the particle feed shaft acting as a melt splitter is large enough, the transverse base can also lie straight in the particle feed shaft and thus be circular with a round internal cross-section of the particle feed shaft.

The transverse base preferably extends over the entire internal cross-section of the particle feed shaft.

The transverse base can be designed as a plate, for example.

In a specific embodiment of the casting apparatus according to the invention, the melt channel splits in the flow direction upstream of the particle feed shaft into two melt sub-channels, which are combined together again at the particle feed shaft. This results in two Y-shaped courses of the metal melt at the particle feed shaft, which cause such flows in the metal melt that the injection of the solid particles into the metal melt is even better. This embodiment is therefore referred to as a double-Y design.

At the point in time at which they trickle into the metal melt, the solid particles are located relatively in the center of the melt flow when viewed across the melt cross-section. A downstream inline treatment of the particle-laden metal melt can compensate for this localized distribution. The solid particles are thus homogeneously distributed and wetted.

In an advantageous embodiment of the casting apparatus according to the invention, an agitator projecting into the flow pathway, the drive shaft of which is arranged in the particle feed shaft, is used as means for such inline treatment. The agitator can be used to reduce the viscosity of the metal melt containing the solid particles for subsequent process steps.

The object is further achieved by a casting method for producing metal matrix composite materials, in which solid particles are added to a metal melt, while the metal melt is flowing in a continuous flow down a melt channel, with the metal melt flowing down along a flow pathway of the melt channel being divided into two partial streams which flow around a particle feed shaft by a particle feed shaft that projects into the flow pathway and thus divides the flow pathway, and at the point where the partial streams combine again after flowing around the particle feed shaft, the solid particles are trickled into the confluence of the partial streams via a particle exit window in the particle feed shaft located above the flow pathway.

With the casting method according to the invention, a high degree of MMC melt quality can be ensured. The casting method according to the invention also allows continuous melting operation under vacuum conditions.

In an advantageous embodiment of the casting method according to the invention, the solid particles are guided to the particle exit window along a transverse base formed in the particle feed shaft and inclined in a particle exit direction.

Preferably, before it passes the particle feed shaft, the metal melt flows into two melt sub-channels of the melt channel, which are combined again at the particle feed shaft.

A preferred embodiment of the present invention is explained in more detail below with reference to figures.

DETAILED DESCRIPTION OF THE INVENTION

Figure 1:
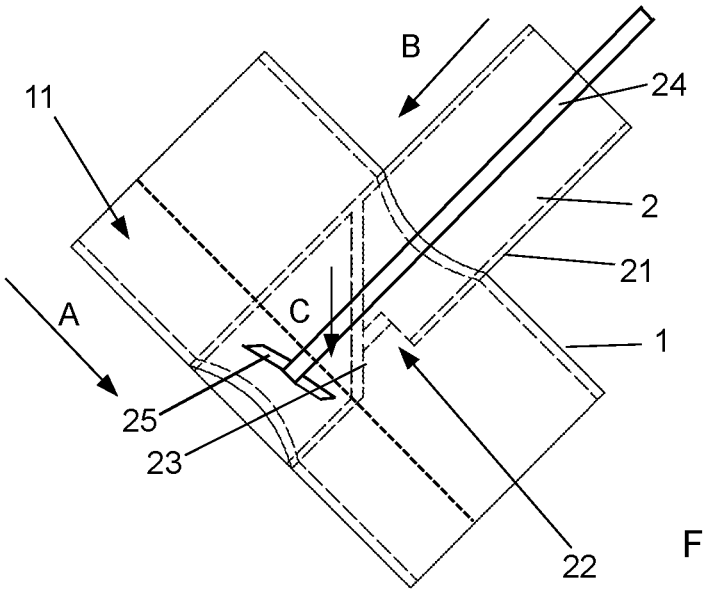
FIG. 1 shows schematically a side view of a particle feed portion of an embodiment of the casting apparatus according to the invention.
Figure 2:
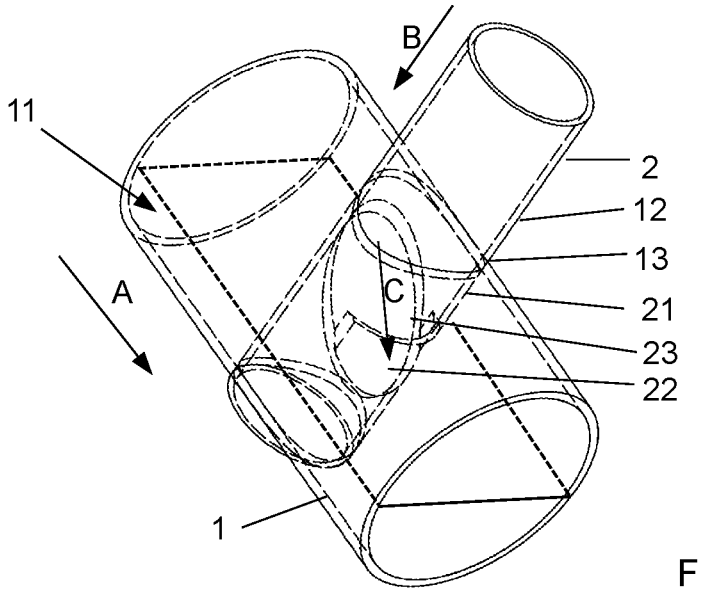
FIG. 2 shows schematically the particle feed portion from FIG. 1 without an agitator in a perspective view.
Figure 3:
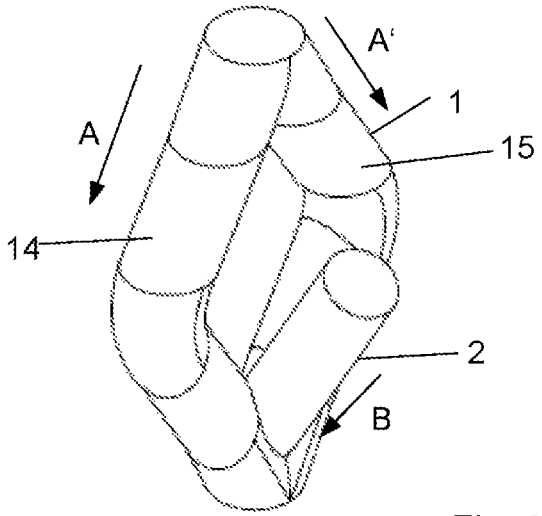
FIG. 3 shows schematically a particle feed portion of another embodiment of the casting apparatus according to the invention.

FIGS. 1, 2, and 3 illustrate the present invention by means of schematic views of a particle feed portion of two different embodiments of a casting apparatus according to the invention.

Upstream of the corresponding particle feed portion, the casting apparatus has at least one component not shown here, such as a metal melting and/or heat retention device for producing a metal melt and/or keeping metal melt hot.

Optionally, downstream of the corresponding particle feed portion, the casting apparatus may have at least one component not shown in the present figures, such as, for example, a mixing zone with at least one mechanical and/or electromagnetic stirrer for distributing solid particles introduced onto or into the metal melt in the particle feed portion.

The particle feed portion shown in each case has a melt channel 1 supplied with metal melt by the metal melting device and a particle feed shaft 2. In the embodiments shown, the melt channel 1 is tubular, i.e. in the form of a melt channel tube or in the form of two tubular melt sub-channels 14, 15 which initially diverge and then converge again. In the embodiments shown, the particle feed shaft 2 is also tubular, i.e. in the form of a particle feed tube.

The melt channel 1 is inclined in a corresponding flow direction A, A' of the casting apparatus. Accordingly, a metal melt flows down a flow pathway 11 formed in the melt channel 1 in the flow direction A, A'.

A through-opening forming a casing feedthrough 13 is formed in a casing of the melt channel 1, which in the exemplary embodiments shown is a tube casing 12, through which through-opening the particle feed shaft 2 is guided into the interior of the melt channel 1. The particle feed shaft 2 projects up to an inner wall of the melt channel 1 opposite the through-opening, i.e. through the flow path 11 in which the metal melt flows. The flow pathway 11 is divided into two partial streams by the particle feed shaft 2, which flow around the particle feed shaft 2 on both sides.

In the exemplary embodiments shown, the particle feed shaft 2 is in each case aligned at an angle of 90° or 45° to an axis of rotation of the melt channel 1, so that its inclination B is aligned at an angle of 90° or 45° to the inclination of the melt channel 1 corresponding to the flow direction A, A'. However, in other embodiments of the present invention, the particle feed shaft 2 may also be perpendicular to the inclined melt channel 1, for example, so that an angle in a range of 30 to 60°, for example 45°, is formed between the center axis of the particle feed shaft 2 and the corresponding flow direction A, A' in the melt channel 1.

The particle feed shaft 2 has an open particle exit window 22 in its shaft casing 21. Furthermore, a transverse base 23 opening into the particle exit window 22 is arranged in the particle feed shaft 2. The transverse base 23 is inclined in a particle exit direction C in the direction of the particle exit window 22.

In the embodiment shown in FIG. 1, the casting apparatus has an agitator 25 projecting into the flow pathway 11. A drive shaft 24 of said agitator 25 is arranged in the particle feed shaft 2.

The casting apparatus according to the invention works, for example, according to the following casting method:

A metal melt is first produced and/or kept hot in the metal melting and/or heat retention device of the casting apparatus. Optionally, the metal melt can be refined and/or modified in the metal melting and/or heat retention device. Like the preferably provided process chamber of the casting apparatus according to the invention, in which the particle feed portion is located, the metal melting and/or heat retention device is operated in a vacuum, i.e. at approx. $10^{-4}$ to 1 mbar, or in a protective gas atmosphere.

In preferred embodiments of the casting apparatus according to the invention, there is a supply line, which can be locked by a vacuum-tight valve device, between the metal melting and/or heat retention device and the process chamber in which the particle feed portion is located. A vacuum melt container is coupled thereto.

Simple embodiments of the present invention can also be designed such that the particle feed portion is not located in a separate process chamber.

Once an identical pressure level has been reached throughout the casting apparatus, the valve device located between the metal melting and/or heat retention device and the process chamber in which the particle feed portion is located is opened and a valve device located between this process chamber and a casting chamber adjacent to the process chamber is closed.

The metal melt produced by the metal melting and/or heat retention device is guided into the vacuum melt container.

In one embodiment of the invention, the melt channel 1, which is introduced into the process chamber from the outside in a vacuum-tight manner, can project into the vacuum melt container from above, for example. In this embodiment, a first portion of the melt channel 1 forms a riser tube. The lower end of the riser tube is always located below a melt surface of the metal melt. An increase in pressure in the metal melting and/or heat retention device causes an increase in melt in the riser tube and thus in the melt channel 1.

When a critical fill level is reached between the melt surface and a lower riser tube edge, the melt channel 1 is filled from an additional melt container by means of gravity. It is also possible to operate the additional melt container under normal atmosphere and to fill the metal melt into the vacuum melt container with the riser tube due to the resulting pressure difference.

However, the present invention is independent of the way of adding the metal melt to the melt channel 1. In particular, the invention is not dependent on whether a riser tube as described above is used. The invention can also be used in gravity casting, for example.

The melt channel 1 is heated directly or indirectly with at least one heating element so that the metal melt cannot solidify in the melt channel 1 at any time.

Another portion of the melt channel 1 is inclined in the corresponding flow direction A, A', i.e. at an angle of about 30 to 60° downwards. As a result, the metal melt flows continuously, i.e. without tearing off, in the corresponding flow direction A, A' within the melt channel 1, along the flow pathway 11 formed on a tube inner side of the melt channel 1.

Insofar as, as in the embodiment shown in FIG. 3, the melt channel 1 temporarily branches out into melt sub-channels 14, 15, the flow pathway 11 also branches out accordingly.

The metal melt, which initially flows as a total stream, is divided into two partial streams by the particle feed shaft 2 at the point where it projects into the flow pathway 11 and divides it. Preferably, the particle feed shaft 2 projects centrally into the flow pathway 11 so that the total stream of metal melt is divided evenly into the two partial streams. In the embodiments shown in FIGS. 1 and 2, the total stream is divided into the two partial streams in a Y-like manner.

In the embodiment of FIG. 3, the particle feed shaft 2 projects into the flow pathway 11 at the point where the two melt sub-channels 14, 15 are combined again.

The partial streams flow around the particle feed shaft 2 on both sides and combine again after passing the particle feed shaft 2.

When solid particles are introduced into the particle feed shaft 2, for example by means of a shaking unit connected to a storage silo or a vibration unit, they initially fall or slide onto the transverse base 23 located in the particle feed shaft 2, supported by the inclination B of the particle feed shaft 2. On the transverse base 23, the solid particles slide obliquely downwards, in accordance with the inclination of the transverse base 23 in the particle exit direction C, in the direction of the particle exit window 22.

The solid particles then trickle out of the particle exit window 22 downwards onto the partial streams of the metal melt flowing back together again. Preferably, the solid particles hit the metal melt exactly where the two partial streams flow together again, i.e. where there is initially a closing gap between the partial streams. This causes the solid particles to be trapped beneath the melt surface.

The inclination B or the angle of inclination of the particle feed shaft 2 determines the point at which the two partial streams combine again.

By adapting the cross-sections of the melt channel 1 and the particle feed shaft 2 in the region of its introduction into the flow pathway 11, almost any amount of melt can be provided with solid particles.

The guidance of the metal melt in the tube system described above means that there is no melt surface open to an oxygen-containing environment and, accordingly, unwanted oxide formation is largely prevented by the low oxygen content in or on the metal melt present in the process chamber.

After the solid particles have been injected into the metal melt, this MMC melt, which is now enriched with the solid particles, flows through a mixing zone of the casting apparatus to homogenize the solid particles and to wet them. To support mixing and wetting, an agitator, such as a two- to four-bladed agitator with a material-specific blade position, can be integrated in the melt channel 1 after the partial streams have been combined in order to reduce the viscosity of the MMC melt.

Finally, the MMC melt is filled into a casting mold to solidify there or is guided into a heatable collecting container in order to collect it there and to then add it to a further processing device, such as a printing or continuous casting line.

In the embodiment of the casting apparatus according to the invention described above, heating elements are preferably located on all components coming into contact with the metal melt or the MMC melt, with the exception of the casting mold, in order to avoid exposing the hot melt with the solid particles to the risk of premature solidification.

The invention claimed is:

1. A casting apparatus for producing metal matrix composite materials, the casting apparatus comprising:

a melt channel being inclined in a flow direction of the casting apparatus and having a flow pathway for a metal melt, said flow pathway having a base; and a particle feed device for adding solid particles to the metal melt, said particle feed device forming a particle feed shaft extending at least to said base of said flow pathway, said particle feed shaft having a shaft casing and a particle exit window formed in said shaft casing.

2. The casting apparatus according to claim 1, wherein:

said melt channel is configured as a melt channel tube having a tube casing;

said particle feed shaft is guided through a casing feed-through formed opposite said flow pathway in said tube casing of said melt channel tube to said flow pathway; and said particle exit window is disposed inside said melt channel tube.

3. The casting apparatus according to claim 2, wherein said particle feed shaft is configured as a particle feed tube.

4. The casting apparatus according to claim 3, wherein said particle feed tube has a smaller tube cross-section than said melt channel tube.

5. The casting apparatus according to claim 1, which further comprises a transverse base formed in said particle feed shaft and opening into said particle exit opening.

6. The casting apparatus according to claim 1, which further comprises an agitator projecting into said flow pathway, said agitator having a drive shaft disposed in said particle feed shaft.

7. The casting apparatus according to claim 1, wherein said melt channel is divided into two melt sub-channels upstream of a location at which the metal melt passes through said particle feed shaft, and said two melt sub-channels are combined again on said particle feed shaft.

8. A casting method for producing metal matrix composite materials, the casting method comprising:

adding solid particles to a metal melt while the metal melt flows in a continuous flow down a melt channel;

using a particle feed shaft projecting into a flow pathway of the melt channel to divide the flow pathway and to divide the metal melt flowing down along the flow pathway into two partial streams flowing around the particle feed shaft; and combining the partial streams again at a location after flowing around the particle feed shaft, and trickling the solid particles at the location into a confluence of the partial streams through a particle exit window in the particle feed shaft located above the flow pathway.

9. The casting method according to claim 8, which further comprises guiding the solid particles along a transverse base formed in the particle feed shaft to the particle exit window.

10. The casting method according to claim 8, which further comprises guiding the metal melt, before the metal melt passes the particle feed shaft, into two melt sub-channels of the melt channel before being combined together again after passing at the particle feed shaft.

* * * * *